United States Patent [19]

Wong

[11] Patent Number: 4,490,670

[45] Date of Patent: Dec. 25, 1984

[54] VOLTAGE GENERATOR

[75] Inventor: Thomas H. Wong, Sunnyvale, Calif.

[73] Assignee: Advanced Micro Devices, Inc., Sunnyvale, Calif.

[21] Appl. No.: 436,761

[22] Filed: Oct. 25, 1982

[51] Int. Cl.[3] ..... G05F 3/16

[52] U.S. Cl. ..... 323/313; 307/297; 323/907

[58] Field of Search ..... 307/296 R, 297; 323/313, 314, 907

[56] References Cited

U.S. PATENT DOCUMENTS

| | | | |
|---|---|---|---|
| 3,651,346 | 3/1972 | Limberg | 307/296 |
| 4,088,941 | 5/1978 | Wheatley, Jr. | 323/226 |
| 4,339,707 | 7/1982 | Gorecki . | |

OTHER PUBLICATIONS

Robert J. Widlar, "New Developments in IC Voltage Regulators", *IEEE Journal of Solid-State Circuits*, vol. SC-6, No. 1, Feb. 1971.

Robert C. Dobkin, "1.2 Volt Reference", *National Semiconductor Application Note*, 1971.

*Primary Examiner*—William M. Shoop

*Attorney, Agent, or Firm*—Patrick T. King; Gary T. Aka; J. Vincent Tortolano

[57] ABSTRACT

A reference voltage generator including a circuit for generating a reference voltage $V_{REF}$ having a non-linear voltage-temperature function, in which the improvement comprises an additional resistor being in circuit to make the function linear. By making the function linear, the equation defining $V_{REF}$ is easily differentiated to determine the change in voltage with temperature.

3 Claims, 2 Drawing Figures

VOLTAGE GENERATOR

DESCRIPTION

1. Technical Field

The present invention relates generally to apparatus for generating a voltage and, more particularly, to a reference voltage generator in which the reference voltage is changeable as a function of temperature.

2. Background Art

Voltage generators are commonly employed in numerous electrical and electronics circuits. Many of these voltage generators are temperature dependent; that is, the output voltage of the generator is variable or changeable as a function of temperature. Reference voltage generators in general, and band gap reference voltage generators in particular, are temperature dependent.

One problem with prior temperature-dependent voltage generators is that it is difficult to determine the change in output voltage with change in temperature. This is because the typical output voltage is non-linear as a function of temperature. Moreover, as will be shown mathematically below, one of the mathematical terms in the equation for determining the output voltage includes the output voltage itself, which adds to the complications of determining such an output voltage.

The present invention is directed to overcoming the above problems.

SUMMARY OF THE INVENTION

The invention is an apparatus having means for generating a voltage, in which the voltage as a function of temperature is non-linear, the improvement comprising means for making the voltage linear as a function of the temperature.

In its simplest form, the means for making constitutes a resistor that is added to the voltage generating means to change the function from one that is non-linear to one that is linear.

DETAILED DESCRIPTION OF THE INVENTION

Figure 1:
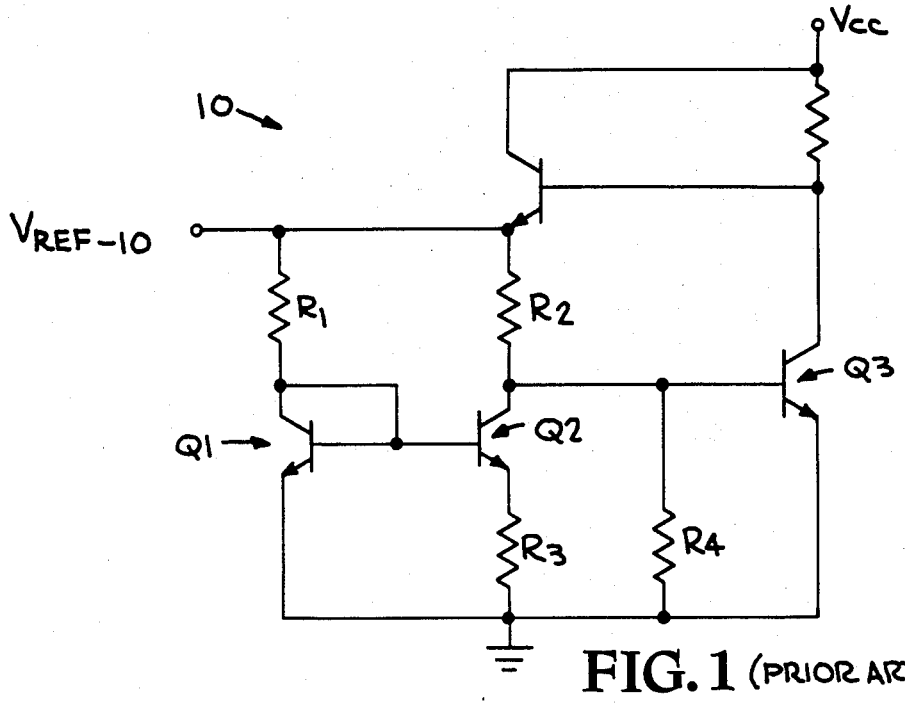
FIG. 1 (PRIOR ART)
FIG. 1 is a schematic illustration of a prior reference voltage generator.
Figure 2:
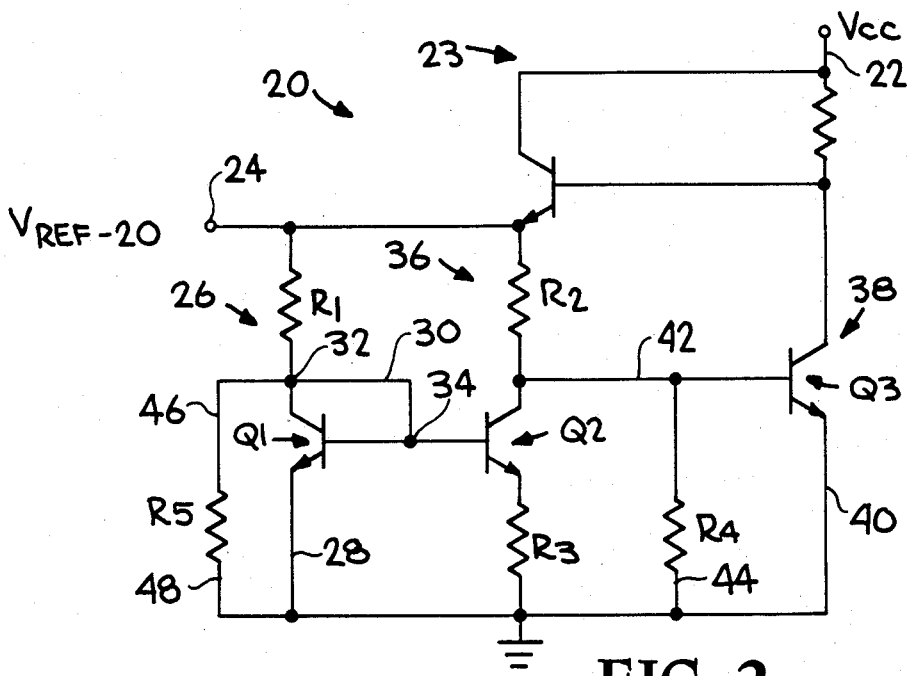
FIG. 2 is a schematic illustration of a reference voltage generator of the present invention.

FIG. 1 shows, schematically, a prior voltage generator 10 for generating, for example, a reference voltage $V_{REF\text{-}10}$. FIG. 2 shows, schematically, a voltage generator 20 of the present invention for generating, for example, a reference voltage $V_{REF\text{-}20}$. In particular, each generator 10 and generator 20 can be a band-gap reference voltage generator. Like letter reference characters, such as $R_1$ and $Q_1$, are used to indicate like components in generator 10 and generator 20.

As can be appreciated by comparing generator 10 with generator 20, the two generators are the same structurally, except that generator 20 has a resistor $R_5$ coupled between the collector of a transistor $Q_1$, and ground. As will be shown mathematically, the addition of resistor $R_5$ makes the reference voltage $V_{REF\text{-}20}$ produced by generator 20 linear as a function of temperature, whereas the reference voltage $V_{REF\text{-}10}$ produced by generator 10 is non-linear.

The reference voltage $V_{REF\text{-}10}$ of generator 10 is determined, as follows:

$$V_{REF\text{-}10} = V_{BE3} + \frac{R_2}{R_3} V_T \ln \frac{I_{Q1}}{I_{Q2}} + \frac{R_2}{R_4} V_{BE3} \tag{1}$$

where:

$V_{BE3}$=base-emitter voltage of transistor $Q_3$;

$$V_T = \frac{kT}{q};$$

k is Boltzmann's constant, T is absolute temperature, and q is the charge of an electron;

$I_{Q1}$=collector current of transistor $Q_1$; and $I_{Q2}$=collector current of transistor Q2.

Equation (1) can be rewritten as:

$$V_{REF\text{-}10} = \left(1 + \frac{R_2}{R_4}\right) V_{BE3} + \frac{R_2}{R_3} V_T \ln \frac{I_{Q1}}{I_{Q2}} \tag{2}$$

where:

$$I_{Q1} = \frac{V_{REF\text{-}10} - V_{BE1}}{R_1}; \tag{3}$$

and $$I_{Q2} = \frac{V_{REF\text{-}10} - V_{BE2}}{R_2} - \frac{V_{BE3}}{R_4} \tag{4}$$

Since $$\frac{I_{Q1}}{I_{Q2}}$$

is not a linear function, and includes $V_{REF\text{-}10}$, the temperature dependency of $V_{REF\text{-}10}$, i.e., $$\frac{dV_{REF\text{-}10}}{dT}$$

is complicated.

However, with the addition of resistor $R_5$ as shown for generator 20, the reference voltage $V_{REF\text{-}20}$ is given as follows:

$$V_{REF\text{-}20} = \left(1 + \frac{R_2}{R_4}\right) V_{BE3} + \frac{R_2}{R_3} V_T \ln \frac{I_{Q1}}{I_{Q2}} \tag{5}$$

$$I_{Q1} = \frac{V_{REF\text{-}20} - V_{BE1}}{R_1} - \frac{V_{BE1}}{R_5} = \frac{1}{R_1}\left(V_{REF\text{-}20} - V_{BE1} - \frac{R_1}{R_5} V_{BE3}\right) \tag{6}$$

$$I_{Q2} = \frac{V_{REF\text{-}20} - V_{BE2}}{R_2} - \frac{V_{BE3}}{R_4} = \frac{1}{R_2}\left(V_{REF\text{-}20} - V_{BE3} - \frac{R_2}{R_4} V_{BE3}\right) \tag{7}$$

Assume that $V_{BE3} \cong V_{BE1}$.

Also, if $$\frac{R_1}{R_5} = \frac{R_2}{R_4},$$

then $$\frac{I_{Q1}}{I_{Q2}} = \frac{R_2}{R_1} = \text{constant} \tag{8}$$

Consequently, the differential of equation (5) is:

$$\frac{dV_{REF\text{-}20}}{dT} = \left(1 + \frac{R_2}{R_4}\right)\frac{dV_{BE3}}{dT} + \left(\frac{R_2}{R_3}\ln\frac{R_2}{R_1}\right)\frac{dV_T}{dT} \tag{9}$$

Thus, since $V_{REF\text{-}20}$ is removed from the right side of equation (9), and since $$\frac{dV_{BE}}{dT}$$

is a known negative quantity, and $$\frac{dV_T}{dT}$$

is a known positive quantity, then by choosing appropriate resistor ratios as given in equation (9), an easily predictable temperature coefficient $$\frac{dV_{REF\text{-}20}}{dT}$$

is obtained.

Structurally, voltage generator 20 has a voltage input 22 coupled through a transistor-resistor network 23, as shown, and an output 24 at which reference voltage $V_{REF\text{-}20}$ is taken. A circuit path 26 of generator 20 includes the series-connected resistor $R_1$ and transistor $Q_1$. One end of resistor $R_1$ is coupled to voltage input 24 through network 23, as shown, and the other end to the collector of transistor $Q_1$. The emitter of transistor $Q_1$ is coupled via a line 28 to ground, while a line 30 is coupled between the other end of resistor $R_1$ and the collector of transistor $Q_1$ at a junction 32 and to the base of transistor $Q_1$ at a junction 34.

Another circuit path 36 includes the series connected resistor $R_2$, transistor $Q_2$ and resistor $R_3$. Resistor $R_2$ has one end coupled to the voltage input 24 through network 23 and the other end coupled to the collector of transistor $Q_2$. The emitter of transistor $Q_2$ is coupled to ground through resistor $R_3$ while the base of transistor $Q_2$ is coupled to junction 34.

Yet another circuit path 38 includes the transistor $Q_3$ having its collector coupled to voltage input 24 through network 23, its emitter coupled to ground via a line 40 and its base connected between the other end of resistor $R_2$ and the collector of transistor $Q_2$ via a line 42.

The resistor $R_4$ has one end coupled to the line 42 and another end coupled to ground via a line 44.

The resistor $R_5$ has one end coupled between the other end of resistor $R_1$ and the collector of transistor $Q_1$, via a line 46, and another end coupled to ground via a line 48.

The band gap reference voltage generator 20 can be implemented in an integrated circuit (IC) using only transistors and resistors formed by conventional IC techniques.

Other aspects, objects and advantages of this invention can be obtained from a study of the drawings and the appended claims.

I claim:

1. In an apparatus having means for generating a reference voltage $V_{REF}$, in which the reference voltage $V_{REF}$ is changeable non-linearly with temperature, the improvement comprising:

means for making the reference voltage $V_{REF}$ changeable linearly with temperature, wherein said means for generating includes:

a voltage input;

a first circuit path, having a series-connected resistor $R_1$ and transistor $Q_1$, connected between said voltage input and ground;

a second circuit path, having a series-connected resistor $R_2$, transistor $Q_2$ and resistor $R_3$, connected between said voltage input and ground;

a third circuit path having a transistor $Q_3$ connected between said voltage input and ground, said transistor $Q_3$ having a base connected between said resistor $R_2$ and the collector of said transistor $Q_2$; and a resistor $R_4$ connected between said base of said transistor $Q_3$ and ground; and wherein said means for making provides the following equation:

$$\frac{dV_{REF}}{dT} = \left(1 + \frac{R_2}{R_4}\right)\frac{dV_{REF}}{dT} + \left(\frac{R_2}{R_3}\ln\frac{\frac{R_1}{R_5}R_2}{\frac{R_2}{R_4}R_1}\right)\frac{dV_{REF}}{dT},$$

T=temperature, k=Boltzmann's constant, q=charge of an electron, and where $R_1$, $R_2$, $R_4$ and $R_5$ are chosen such that $$\frac{R_1}{R_5} = \frac{R_2}{R_4},$$

so that $$\frac{R_2}{R_1} = \text{constant},$$

and wherein said means for making comprises a resistor $R_5$ being connected to eliminate $V_{REF}$ on the right side of said equation.

2. Apparatus, according to claim 1, wherein the base of said first transistor $Q_1$ and the base of said second transistor $Q_2$ are connected in common between said resistor $R_1$ and the collector of said transistor $Q_1$.

3. An apparatus in claim 1 wherein said means for generating a reference voltage $V_{REF}$ further includes:

(a) a voltage input;

(b) a first circuit path having said resistor $R_1$ having one end coupled to said voltage input and a transistor $Q_1$ having its base and collector coupled to the other end of said resistor $R_1$ and its emitter coupled to ground;

(c) a second circuit path having said resistor $R_2$ having one end coupled to said voltage input, a transistor $Q_2$ having its collector connected to the other end of resistor $R_2$, its base connected to the other end of resistor $R_1$ and an emitter, and said resistor $R_3$ having one end connected to the emitter of said transistor $Q_2$ and the other end connected to ground;

(d) a third circuit path having said transistor $Q_3$ having its collector coupled to said voltage input, its emitter coupled to ground and its base connected to the other end of said resistor $R_2$;

(e) said resistor $R_4$ connected between said base of said transistor $Q_3$ and ground; and (f) said resistor $R_5$ connected between the other end of said resistor $R_1$ and the collector of said transistor $Q_1$ and ground.

* * * * *